United States Patent [19]

Taylor et al.

[11] 4,316,636

[45] Feb. 23, 1982

[54] EXCAVATION AND ROAD MAINTENANCE BITS AND BLOCKS

[75] Inventors: Jack A. Taylor, Ligonier; Wayne H. Beach, Roaring Spring; Raymond C. Weyant, Jr., New Paris, all of Pa.

[73] Assignee: Kennametal Inc., Latrobe, Pa.

[21] Appl. No.: 185,272

[22] Filed: Sep. 8, 1980

Related U.S. Application Data

[63] Continuation of Ser. No. 8,435, Feb. 1, 1979, abandoned.

[51] Int. Cl.[3] ..... E21C 35/18

[52] U.S. Cl. ..... 299/92; 175/413; 37/142 A

[58] Field of Search ..... 299/86, 91–93, 299/39–41; 175/413; 37/142 A; 407/47; 404/121; 172/713

[56] References Cited

U.S. PATENT DOCUMENTS

| | | | |
|---|---|---|---|
| 251,103 | 12/1881 | Fargo | 172/713 |
| 3,143,177 | 8/1964 | Galorneau et al. | 299/91 X |
| 3,318,401 | 5/1967 | Carbert | 175/413 |
| 3,820,848 | 6/1974 | Kniff | 299/86 |
| 4,006,936 | 2/1977 | Crabiel | 299/92 X |

FOREIGN PATENT DOCUMENTS

| | | | |
|---|---|---|---|
| 816565 | 7/1969 | Canada | 299/92 |
| 205760 | 1/1968 | U.S.S.R. | 299/92 |

*Primary Examiner*—Ernest R. Purser
*Attorney, Agent, or Firm*—Lawrence R. Burns

[57] ABSTRACT

A bit and block are disclosed wherein the bit has a flat bar-like forward working portion and a shank rearwardly of said forward working portion. The shank, when viewed in cross section, has a non-circular shape so that, when placed in a support block having a bore of similar size and shape, the bit will not rotate in the block. An expansible clip is used at the rear end of the bit, behind the shank portion, to hold the bit in the block.

11 Claims, 9 Drawing Figures

EXCAVATION AND ROAD MAINTENANCE BITS AND BLOCKS

This is a continuation of application Ser. No. 008,435, filed Feb. 1, 1979 and now abandoned.

BACKGROUND OF THE INVENTION

This invention relates to excavation and construction tools and is especially concerned with blocks and bits used in road maintenance construction.

Recent advances in road maintenance techniques have involved the processes of soil stabilization, asphalt reclamation, road planing and other advances that concern themselves with the conservation of materials already present in old roadbeds and the like.

Road planing, for instance, involves the mounting of bits and blocks on a power driven rotary drum. Asphalt is planed off the old road surface as the drum rotates and the bits strike or dig into the roadway. In asphalt, it is preferable to use bits that have a flat edge to shave the asphalt, rather than point-attack type bits that dig rather than scrape. This is because point-attack type bits find their greatest use in material that fractures once penetrated. Asphalt does not readily fracture once penetrated and, therefore, flat edged scraping type tools work best when road planing.

The point-attack type bits originally developed for coal mining (see U.S. Pat. No. 3,519,309) also found great use in construction type tools and other excavation type operations. One of the favorable features of the point-attack bit was the retention of the bit in its support block by a resilient split keeper ring, described more fully in U.S. Pat. No. 3,752,515.

Because the above-mentioned ring affords a very satisfactory and workable connection of the bit to the block, the use of such a ring has become almost universal in the industry. It is, therefore, desirable to retain the resilient keeper ring when designing a bit for use with road planing equipment.

Cutter bits have been designed having flat forwardly working cutting edges for road planing but retaining the cylindrical shank, clip and recess of the point-attack type tools. Rotation is resisted by tangs that entered from the bit to the block or pins may be utilized extending through the bore of the block and mating with a special flat on the shank of the bit. Some instance of rotation still occurs, probably because impacting the bit can cause it to bounce longitudinally in its holder and possibly displace any tang or other extension utilized to prevent rotation.

BRIEF SUMMARY OF THE INVENTION

According to the present invention, a road planing tool is disclosed having a forward working portion, a shank portion and attachment means for holding said tool in a mounting block.

The tool has a flat bar-like forward working portion with laterally extending shoulders and a rearwardly facing abutment shoulder formed at the juncture of the forward working portion with the shank.

The shank portion of the tool, when viewed in cross section, has lateral sides and a top and bottom side and a non-circular cross sectional shape so it will not rotate when placed in a block having a similarly shaped and sized bore. The preferable cross sectional shape of the shank portion is a semi-circular and semi-rectangular cross section, although other non-round cross sectional shape, such as a polygonal trapezoidal shape, might also work.

Rearwardly of the shank portion is a circular section with a rearwardly located flange around which is located a resilient clip that engages the bore in the block to hold the bit in the block. Preferably, the circular portion is recessed so as to produce the flanged part and seat the clip.

It is an object of the present invention to provide a nonrotatable road planar bit.

It is a further object of the present invention to provide a bit and block especially designed for road planing applications.

The exact nature of the present invention will become more clearly apparent upon reference to the following detailed specification taken in connection with the accompanying drawings in which:

DETAILED DESCRIPTION OF THE INVENTION

Figure 1:
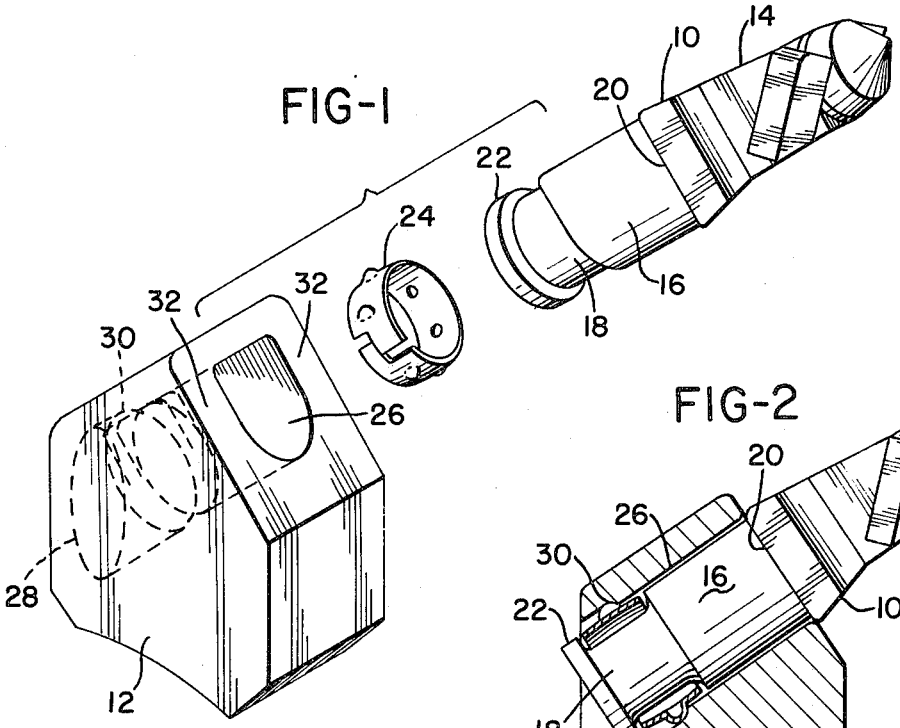
FIG. 1 is a perspective view showing the assembly of the bit, clip and block according to the present invention.

Referring to the drawings somewhat more in detail, shown in FIG. 1 is a bit 10 which fits into a block 12 that may be mounted upon a power driven rotatable drum such as is used in road planing operations.

Bit 10 has a forward working portion 14, a shank portion 16 and a rearmost circular portion 18. Forward working portion 14 is flat and bar-like and has a rearwardly facing shoulder 20 formed at the juncture of the shank portion 16 with the forward working portion 14. Circular rearward portion 18 has a flange 22 formed thereon so that resilient clip 24 will fit around the circular portion 18 and hold the bit 10 in the block 12.

Figure 2:
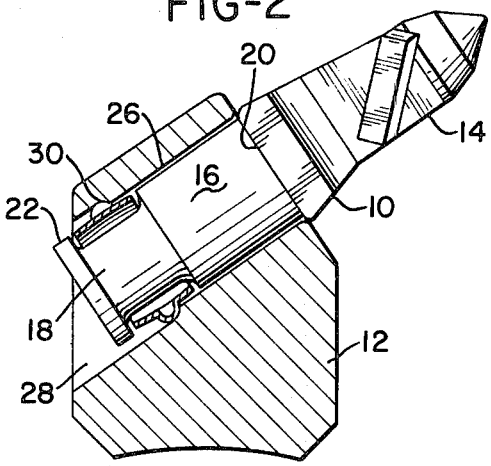
FIG. 2 is a side view of the bit, clip and block of the present invention.

Referring to FIG. 2, what is shown therein is the bit 10 assembled in the block 12 with the block 12 having a bore that, in cross section is similarly shaped and sized to the shank portion 16 of bit 10. By similarly shaped and sized, it is understood that the bore 26 of block 12 will be sized so as to accept shank 16 of block 12 and hold the bit 10 so that it is nonrotatable with respect to the block.

Figure 3:
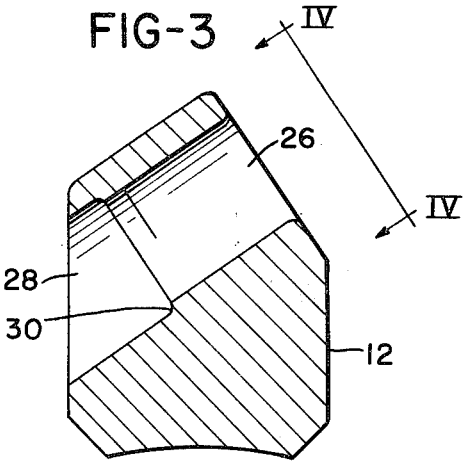
FIG. 3 is a side view of the block according to the present invention.

Referring to FIG. 3, what is shown therein is bore 26 formed in block 12 and having a rearward portion 28 that is circular in nature and, preferably, forms the internal shoulder 30. Clip 24 will then have means for abutting internal shoulder 30 as is shown above in FIG. 2 and will hold the bit within block 12.

Figure 4:
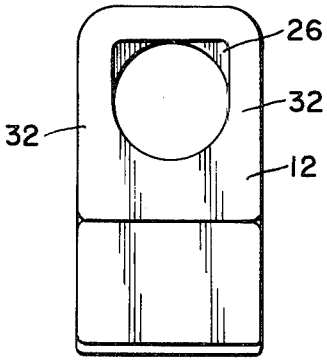
FIG. 4 is a view IV—IV through FIG. 3.

FIG. 4 shows a view IV—IV of FIG. 3. In FIG. 4, it is preferable that the cross sectional shape 26 is nonround in configuration and, as shown in FIG. 4, comprises a semi-circular shape on the bottom and a semi-rectangular shape on top.

Figure 5:
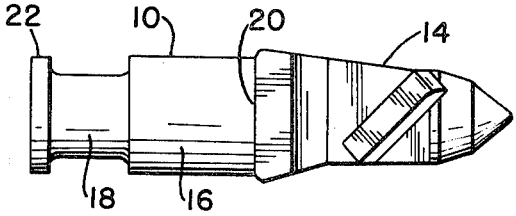
FIG. 5 is a side view of the bit according to the present invention.
Figure 6:
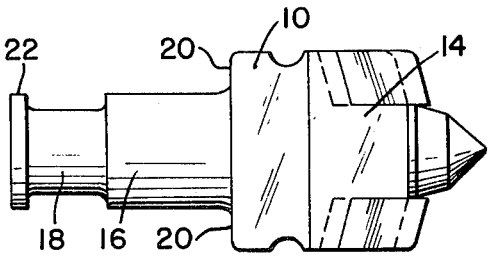
FIG. 6 is a plan view of the bit according to the present invention.

FIGS. 5 and 6 show a side view and a plan view of the bit 10 according to the present invention that more fully illustrates the laterally extending shoulders 20 that form rearwardly facing abutment surfaces on the bit 10. Rearwardly facing abutment surfaces 20, of course, will abut with surfaces 32 and block 12 as shown in FIG. 1.

Figure 7:
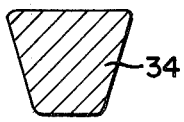
FIGS. 7, 8 and 9 are cross sectional shapes of the shank portion of the bit according to the present invention.
Figure 8:
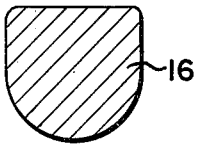
Figure 9:
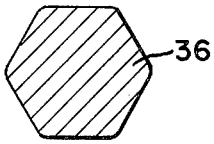

FIGS. 7, 8 and 9 illustrate various non-circular and non-rectangular cross sectional shapes that the shank 16 and the bore 26 can have. In FIG. 7, the cross sectional shape of the shank 16 or the bore 26 can have a polygonal shape 34 which, as shown in FIG. 7, is preferably a trapezoid.

In any event, it is desired that the cross sectional shapes are rotationally non-symmetric when placed in a similarly shaped and sized bore.

FIG. 8 shows that the shank 16 of the bit 10 can have a semi-circular shape and a semi-rectangular shape so as to mate with the bore 26 shown in block 12 of FIG. 4.

FIG. 9 shows another polygonal configuration 36 that may be adapted to the shank portion 16 in the bore 26 which must mate together so as to prevent rotation of the bit 10 and block 12.

Each of FIGS. 7 and 8 has sides with a unique length so that they will be uniquely oriented when placed in a similarly shaped and sized bore.

Modifications may be made within the scope of the appended claims.

What is claimed is:

1. A road planing tool which comprises: a forward working portion, a shank portion and attachment means for holding said tool in a mounting block, said forward working portion being flat, bar-like, and having laterally extending shoulders, a rearwardly facing abutment shoulder formed at the juncture of said shank portion and said working portion, said shank portion having a non-circular and non-rectangular cross section so as not to rotate when placed in a block having a similarly shaped and sized bore, said non-circular and non-rectangular cross section of said shank having a side of unique length so as to be uniquely oriented when placed in said block having a similarly shaped and sized bore, a flanged portion rearwardly of said shank and resilient clip means around said bit forwardly of said flanged portion for engaging the bore of the block and holding the bit in the block.

2. A road planing tool which comprises: a forward working portion, a shank portion and attachment means for holding said tool in a mounting block, said forward working portion being flat, bar-like, and having laterally extending shoulders, a rearwardly facing abutment shoulder formed at the juncture of said shank portion and said working portion, said shank portion having a cross section which is rotationally nonsymmetric about a longitudinal axis containing its geometric center and which is in and of itself sufficient to assure that said tool will be held nonrotatably and with a unique orientation when placed in a block having a similarly shaped and sized bore, a flanged portion rearwardly of said shank and resilient clip means around said bit forwardly of said flanged portion for engaging the bore of the block and holding the bit in the block.

3. A road planing tool according to claim 1 or 2 in which said shank is semi-circular and semi-rectangular when viewed in cross section.

4. A road planing tool according to claim 3 in which a circular recess is provided on said bit between said shank and said flange and said clip, fits around said recess.

5. A block assembled with a bit according to claim 3 and having a bore similarly shaped as said cross section of said shank and sized so as to prevent rotation of said bit in said block and an enlarged recess behind said bore for engaging said clip on said bit.

6. A road planing tool according to claim 1 or 2 in which said shank is trapezoidal in cross section so as not to allow rotation when placed in a block having a similarly sized and shaped bore.

7. A road planing tool according to claim 6 in which a circular recess is provided on said bit between said shank and said flange and said clip fits around said recess.

8. A block assembled with a bit according to claim 6 and having a bore similarly shaped as said cross section of said shank and sized so as to prevent rotation of said bit in said block and an enlarged recess behind said bore for engaging said clip on said bit.

9. A block assembled with a bit according to claim 1 or 2 and having a bore similarly shaped as said cross section of said shank and sized so as to prevent rotation of said bit in said block and an enlarged recess behind said bore for engaging said clip on said bit.

10. A road planing bit according to claim 1 or 2 in which said shank has a polygonal portion when viewed in cross section.

11. A block assembled with a bit according to claim 10 and having a bore assembly shaped and sized similarly to said cross section of said shank of said bit so as to prevent rotation of said bit in said block.

* * * * *